United States Patent [19]

Overton et al.

[11] Patent Number: 4,781,854

[45] Date of Patent: Nov. 1, 1988

[54] LIQUID BLEACHING COMPOSITIONS

[75] Inventors: Colin Overton, Bromborough, Wirral, Great Britain; Phillip E. Figdore, Franklin Lakes, N.J.

[73] Assignee: Lever Brothers Company, New York, N.Y.

[21] Appl. No.: 33,888

[22] Filed: Apr. 2, 1987

Related U.S. Application Data

[63] Continuation of Ser. No. 843,966, Mar. 25, 1986, abandoned.

[30] Foreign Application Priority Data

Mar. 27, 1985 [GB] United Kingdom ..... 8508010

[51] Int. Cl.[4] ..... C11D 7/54

[52] U.S. Cl. ..... 252/100; 252/101; 252/142; 252/173; 252/174.21; 252/540; 252/559; 252/186.28; 252/186.42; 252/DIG. 14

[58] Field of Search ..... 252/100, 101, 136, 142, 252/173, 174, 174.21, 540, 559, DIG. 14, 186.28, 186.43; 134/2, 3

[56] References Cited

U.S. PATENT DOCUMENTS

| | | | |
|---|---|---|---|
| 1,750,657 | 3/1930 | Adolph et al. | 252/186.43 |
| 2,882,121 | 4/1959 | Fell | 252/186.43 |
| 3,083,166 | 3/1963 | Harding | 252/100 |
| 3,194,768 | 6/1965 | Lindner | 252/100 |
| 3,556,846 | 1/1971 | Hnizda | 252/100 |
| 4,157,977 | 6/1979 | Dewar et al. | 252/142 |
| 4,238,192 | 12/1980 | Kandathil | 252/100 |
| 4,666,622 | 5/1987 | Martin et al. | 252/99 |

FOREIGN PATENT DOCUMENTS

| | | |
|---|---|---|
| 131394 | 1/1985 | European Pat. Off. . |

*Primary Examiner*—Paul Lieberman
*Assistant Examiner*—Hoa Van Le
*Attorney, Agent, or Firm*—Milton L. Honig; James J. Farrell

[57] ABSTRACT

The invention pertains to an aqueous stable thickened low-pH bleaching composition which comprises a thickening synthetic anionic surfactant of the sulphonic acid or salt type, a cold-water-soluble inorganic peroxy compound, in particular peroxymonosulphate, and a mineral acid to yield a pH of below 4.

7 Claims, No Drawings

LIQUID BLEACHING COMPOSITIONS

This is a continuation of application Ser. No. 843,966, filed Mar. 25, 1986, now abandoned.

The present invention relates to bleach-containing cleaning compositions and, in particular, to thickened liquid cleaning compositions which are based on an aqueous solution of a bleaching agent selected from the group of inorganic peroxy acids or salts thereof.

Inorganic peroxy acids such as peroxymonosulphuric acid or peroxymonophosphoric acid are well known for their oxidative properties, and have been proposed for a number of specialized uses, such a shrink-proofing, textile bleaching, denture cleaning etc.

In U.S. Pat. No. 3,556,711 aqueous bleaching compositions are disclosed wherein peroxymonosulphate is used in combination with an aliphatic monocarboxylic acid salt. The compositions, which are useful in textile bleaching, are non-thickened and have a pH of 5 to 10.

In the British patent application No. 2,022,641 liquid bleaching and softening compositions are described including a water-soluble peroxy bleaching agent, which comprises at least 50% of hydrogen peroxide and, optionally, an auxiliary bleaching agent which may be selected from the group of peroxycarbonates, peroxyborates, peroxymonosulphates and peroxymonophosphates etc. The compositions are non-thickened and adjusted to pH of 4 to 5.

In the U.S. Pat. No. 3,149,078 liquid abrasive cleaning compositions are described for which the optional inclusion of peroxymonosulphate is mentioned.

To our knowledge, up till now the inclusion of inorganic peroxy acids in thickened low-pH liquid products has not been disclosed.

Although in the British Pat. No. 2,073,233 thickened low-pH hard-surface cleaning compositions have been proposed, the formulation of stable products including a bleaching agent has proven quite troublesome.

Thickened bleach-containing hard-surface cleaning products are widely used in the hygienic cleaning of lavatory pans, urinals, drains, waste pipes and the like. It is essential that such products are thickened to viscosities which enable optimal performance even at non-horizontal surfaces. By far the majority of these products are based on a hypochlorite bleaching agent and, accordingly, such compositions are highly alkaline in order to obtain the necessary stability of the hypochlorite bleaching agent. Owing to the high alkalinity, precipitation of water-hardness salts from toilet flush water can be caused. Such products cannot be made acidic, for this can lead to release of chlorine gas and associated safety problems.

Acidic products based on hydrogen peroxide solutions are poor bleaches and have grossly inferior germicidal properties when compared to the alkaline hypochlorite-based products.

It is now an object of the present invention to provide an effectively bleaching hard-surface cleaning composition which is based on acidic bleach. It is a further object to provide such compositions which are thickened to viscosities which enable them to adhere to non-horizontal surfaces for sufficient time and to perform their bleaching object of the present invention to provide such compositions which are physically and chemically stable for prolonged periods of time.

It has now been found that by using a thickening system based on specific synthetic anionic surfactants capable of thickening at acid pH, physically and chemically stable liquid bleaching compositions can be formulated comprising an inorganic water-soluble peroxy compound.

Accordingly, the present invention provides stable aqueos thickened low-pH bleaching compositions which comprise a thickening synthetic anionic surfactant selected from the group of alkyl-, alkenyl- and alkylaryl sulphonic acids, -polyglycolether sulphonic acids, and the salts thereof, a cold-water-soluble inorganic peroxy compound and an acidic compound capable of providing the composition with a pH value of below 4.

The inorganic peroxy compounds for use in the composition of the present invention must be cold-water-soluble and provide a bleaching action at lower pH values, in particular at pH values below 4. Suitable examples are the group VA and VIA peroxides, such as peroxymonophosphoric acid, peroxydiphosphoric acid, peroxymonosulphuric acid, peroxydisulphuric acid and the alkali metal and ammonium salts thereof, in particular tetrapotassium peroxydiphosphate, tetrasodium pyrophosphate bis(peroxyhydrate), diammonium peroxydisulphate, dipotassium peroxydisulphate, disodium peroxydisulphate and the triple salt oxone peroxymonosulphate.

Peroxymonosulphuric acid and the alkali metal and ammonium salts thereof are preferred. Peroxymonosulphuric acid is commercially available in aqueous solution as Caro's acid prepared by addition of concentrated hydrogen peroxide to concentrated sulphuric acid.

Depending on the mixing ratio and initial concentrations of the acid and the hydrogen peroxide, the composition of Caro's acid can vary to some extent. Conventionally, concentrated sulphuric acid (96–98%) is added to a hydrogen peroxide solution of about 70% in a ratio within the range of 0.5:1 to 1:3. Relatively high levels of $H_2SO_5$ can be achieved by mixing e.g. 96%-$H_2SO_4$ and 85%-$H_2O_2$ in equimolar ratio resulting in a Caro's acid composition comprising about 49% by weight of $H_2SO_5$, about 26% by weight of $H_2SO_4$ and about 9% by weight of $H_2O_2$. However, to avoid the safety hazards attached to very high concentrations of $H_2O_2$, it may be desirable to start with e.g. equimolar amounts of 98%-$H_2SO_4$ and 50%-$H_2O_2$, which results in a Caro's acid composition comprising about 23% by weight of $H_2SO_5$, about 40% by weight of $H_2SO_4$ and about 13% by weight of $H_2O_2$.

An alternative form of Caro's acid is prepared by electrolysis of ammonium sulphate, resulting in an aqueous solution of ammonium bisulphate and peroxymonobisulphate.

In solid form it is commercially available as the triple salt $KHSO_5$:$KHSO_4$:$K_2SO_4$ in the molar ratio of about 2:1:1, and, accordingly, comprises about 40% by weight of the active oxygen compound, corresponding to about 5% active oxygen by weight of the triple salt.

The amount of active oxygen which should be available in the instant compositions ranges from 0.08 to about 1% by weight of the total composition. Accordingly, the inorganic peroxy compound is included in an amount of from 0.5 to 10% by weight of the total composition, calculated on the basis of the simple peroxy acid form. Preferably, the peroxy compound is included in an amount of from 1.8 to 5.7% by weight.

Optionally, also small amounts of hydrogen peroxide may be included in addition to the inorganic peroxy compound. Suitably, hydrogen peroxide is included in an amount of from 1 to 5% by weight.

Suitable degrees of thickening will be achieved with viscosities which range from 10 to 250 mPa.s and preferably from 20 to 100 mPa.s. According to the present invention the above viscosities are obtained by way of a thickening system comprising as essential components a synthetic anionic surfactant capable of thickening at acid pH, and an acid providing the composition with a pH value of below 4.

The synthetic anionic surfactant is selected from the alkyl-, alkenyl- and alkylaryl sulphonic acids, -polyglycolether sulphonic acids, and the alkali metal, ammonium and substituted ammonium salts thereof.

Particularly suitable are primary and secondary alkyl sulphonates having from 8 to 22 carbon atoms in the alkyl radical, primary and secondary alkylene sulphonates having from 8 to 24 carbon atoms in the alkenyl radical, alkylaryl sulphonates having from 9 to 20 carbon atoms in the alkylaryl radical and the polyglycolether sulphonate analogs of the aforementioned types having from 8 to 18 carbon atoms in the alkyl, alkenyl or alkylaryl radical and from 1 to 4 carbon atoms in the alkyl linkage between the polyglycol portion and the sulphonate group. Preferred are the alkylaryl sulphonates and the polyglycolether sulphonate analogs thereof.

The concentration of the thickening surfactant lies within the range of from 0.5 to 20% by weight of the total composition, the range from 1 to 7.5% by weight being preferred.

The thickening surfactant can be the sole surfactant material, but also other surfactants can be included in combination therewith up to an amount of 5% by weight of the total composition. Suitable co-surfactant materials are the more soluble anionic and nonionic surfactant materials, and to a lesser extent nitrogen-based surfactant materials.

Examples of such materials include the alkoxylation products of primary and secondary fatty alcohols, in particular the secondary alcohol ethoxylates having from 10–15 carbon atoms and 5–15, preferably 5–9 ethylene oxide units. Alkoxylated octyl and nonyl phenols can also be used.

Also anionic co-surfactants other than the major anionic thickening surfactant may be used instead of or in admixture with the nonionic co-surfactant. Suitable examples thereof are the carboxylated and sulphated derivatives of ethoxylated fatty alcohols and linear alkylsulphates.

Only minor amounts of conventional nitrogen-based surfactants, such as aminoxide, amines and cationics, can be included.

When a combination of thickening surfactant/co-surfactant is used, the weight ratio between the thickening surfactant and the co-surfactant is preferably at least 1:1 and more preferably at least 3:1.

The second component which is essential in obtaining stable and long-lasting thickening is an acidic compound, i.e. a compound capable of providing the composition with a pH value of below 4. The acidic compound should be compatible with the peroxy compound.

Suitable acidic compounds are in particular found among the strong mineral acids, such as nitric acid, phosphoric acid, sulphuric acid, and the partial salts thereof. Preferred are phosphoric and sulphuric acid and the partial salts thereof.

Mixtures of different acids may also be used as well as combinations of acids and the corresponding partial salts.

Suitable salts include the alkali metal salts of phosphoric and sulphuric acids, such as e.g. potassium biphosphate and sodium bisulphate.

The acidic compound is included in concentrations up to 50% by weight of the total composition and in particular in concentrations of from 0.5 to 20% by weight, the concentration range of from 1 to 5% by weight being preferred.

The acid or acid/salt combination should provide the compositional solutions with a pH value of below about 4, pH values of below 2.5 being preferred.

The compositions of the present invention may further include conventional additives to improve their effectiveness and/or consumer acceptability. More in particular, the compositions may contain one or mre perfumes, dyes, colouring agents, bactericides, builders, additional thickeners, hydrotropes, in particular sodium xylene sulphonate or tertiary butanol, opacifiers or other additives compatible with the bleach system (such as hydrogen peroxide).

Preferably, the compositions of the present invention are coloured by inclusion of coloured polymer particles as disclosed in the co-pending British patent application No. 8315838 incorporated herein by reference.

The invention will now further be illustrated by way of examples. All quantities are quoted as percentages by weight based on the total weight of the composition unless otherwise indicated.

The examples are to 100% with distilled water. All components are quoted as 100% active.

EXAMPLE I

| Ingredients | 1 | 2 | 3 | 4 | 5 | 6 | 7 | 8 | 9 | 10 | 11 | 12 |
|---|---|---|---|---|---|---|---|---|---|---|---|---|
| $H_2SO_5$ | 1.5 | 2 | 2.5 | 3 | 4 | 6 | 4 | 4 | 5 | 4 | 3.7 | 6 |
| $H_2SO_4$ | 0.6 | 0.8 | 1 | 1.2 | 1.6 | 2.3 | 1.6 | 1.6 | 1.9 | 1.6 | 1.4 | 2.3 |
| $H_2O_2$ | 0.2 | 0.2 | 0.3 | 0.3 | 0.5 | 0.7 | 0.5 | 0.5 | 0.6 | 0.5 | 0.4 | 0.7 |
| DOBS 80(1) | — | — | — | — | — | 4 | 1.5 | 3 | 5.2 | 3 | 1.9 | 6 |
| DOBS 83(2) | — | — | — | — | 4 | — | — | — | — | — | — | — |
| DOBS 102(3) | 5 | 5 | 5 | 2 | — | — | 3 | 3 | 3 | 6 | 0.9 | — |
| Alkyl polyglycolether sulphonate ($C_{12}$–$C_{15}$, $EO_{10}$) | — | — | — | — | — | — | — | — | — | — | 2.4 | — |
| Initial viscosity (mPa.s, at 21 $s^{-1}$) | 20 | 50 | 55 | 25 | 40 | 25 | 55 | 45 | 59 | 75 | 49 | 25 |
| Viscosity after 2 months | | | 70 | | | | | | | | | |
| Bleach level after 2 months (% of initial level) | | | 90 | | | | | | | | | |
| pH | | | | | 0.36 | | | | | | | 0.23 |

(1)DOBS 80 is ($C_9$–$C_{11}$) alkylbenzene sulphonic acid ex Shell.
(2)DOBS 83 is ($C_9$–$C_{13}$) alkylbenzene sulphonic acid ex Shell.
(3)DOBS 102 is ($C_{10}$–$C_{12}$) alkylbenzene sulphonic acid ex Shell.

EXAMPLE II

| Ingredients | 1 | 2 | 3 | 4 | 5 |
|---|---|---|---|---|---|
| KMPS Triple salt[1] | 8.3 | 9 | 2.9 | 7.5 | 7.8 |
| DOBS 80 | 4.2 | 6 | — | 4 | — |
| DOBS 83 | — | — | 4.9 | — | — |
| DOBS 102 | — | — | 0.5 | — | 3.9 |
| Dobanol 23-3S[2] | — | — | — | 1.6 | 2.4 |
| Initial viscosity (mPa.s, at 21 $s^{-1}$) | 20 | 36 | 25 | 28 | 43 |
| pH | 0.96 | | 0.86 | 0.96 | 1.00 |

[1]KMPS Triple salt composition: $KHSO_5$:$KHSO_4$:$K_2SO_4$ in a molar ratio of 2:1:1.
[2]Dobanol 23-3S is a sulphonated primary ($C_{12}$–$C_{13}$ alcohol ethoxylate ($EO_3$) ex Shell.

EXAMPLE III

| Ingredients | 1 | 2 | 3 | 4 | 5 | 6 | 7 |
|---|---|---|---|---|---|---|---|
| $H_2SO_5$ | 3.3 | 2.1 | 3.4 | 1.1 | 4.4 | 3.2 | 1.9 |
| $H_2SO_5$ | 3.0 | 1.9 | 3.6 | 2.0 | 4.1 | 2.8 | 1.5 |
| DOBS 102 (Na-salt) | 3.2 | — | — | 3.3 | — | 4.0 | — |
| DOBS 102 (acid form | — | 3.5 | — | — | — | — | 4.7 |
| SAS[1] | — | — | 5.4 | — | 6.2 | 1.0 | — |
| Coloured polystyrene latex[2] | — | — | — | — | — | — | 0.1 |
| Initial viscosity (mPa.s, at 21 $s^{-1}$) | 41 | — | 14 | 55 | 14 | 41 | — |
| Viscosity after 7 months | 27 | 71 | 22 | 50 | 23 | 37 | 38 |
| Bleach level after 7 months (% of initial level) | 25 | 70 | 46 | 76 | 33 | 44 | 70 |

[1]SAS is the sodium salt of a secondary ($C_{13}$–$C_{17}$) alkane sulphonate.
[2]Red polymer latex prepared as described in the British Patent Application No. 8315838.

EXAMPLE IV

| Ingredients | 1 | 2 | 3 | 4 |
|---|---|---|---|---|
| $H_2SO_5$ | 3.6 | 4.0 | 3.0 | 3.0 |
| $H_2SO_4$ | 1.9 | 6.8 | 5.1 | 1.4 |
| $H_2O_2$ | 0.5 | 0.1 | 0.1 | trace |
| $(NH_4)_2SO_4$ | — | — | — | 6.7 |
| DOBS 80 | — | 6.0 | 4.0 | 4.0 |
| DOBS 83 | 3.6 | — | — | — |
| DOBS 102 | — | 1.0 | 2.0 | — |
| Sodium dodecyl sulphonate | — | — | — | 1.0 |
| Initial viscosity (mPa.s, at 21 $s^{-1}$) | 40 | 45 | 55 | 50 |
| pH | 0.44 | | | |

EXAMPLE V

| Ingredients | 1 | 2 | 3 | 4 | 5 | 6 | 7 | 8 | 9 | 10 |
|---|---|---|---|---|---|---|---|---|---|---|
| $H_2SO_5$ | 3.0 | 4.0 | 4.0 | 4.0 | 4.0 | 4.0 | 4.0 | 4.0 | 3.6 | 3.3 |
| $H_2SO_4$ | 1.2 | 1.6 | 1.6 | 1.6 | 1.6 | 1.6 | 1.6 | 1.6 | 1.4 | 1.3 |
| $H_2O_2$ | 0.3 | 0.5 | 0.5 | 0.5 | 0.5 | 0.5 | 0.5 | 0.5 | 3.1 | 2.9 |
| DOBS 80 | — | 4.0 | 3.0 | 2.1 | 4.0 | — | — | 1.0 | 2.7 | 4.2 |
| DOBS 102 | 3.0 | — | 3.0 | 3.0 | 2.0 | 3.3 | 2.0 | — | — | — |
| Dobanol 23-3S | 0.5 | — | — | — | — | — | — | — | 2.3 | 2.1 |
| Akypo TFC[1] | — | 1.0 | — | — | — | — | — | — | — | — |
| Akypo RLM100[2] | — | — | 1.0 | — | — | — | — | — | — | — |
| Akypo RLM160[3] | — | — | — | 1.0 | — | — | — | — | — | — |
| Sodium dodecyl sulphonate | — | — | — | — | 1.0 | 1.0 | — | — | — | — |
| Emal 10[4] | — | — | — | — | — | — | 0.5 | — | — | — |
| SAS | — | — | — | — | — | — | — | 0.4 | — | — |
| Initial viscosity (mPa.s, at 21 $s^{-1}$) | 55 | 23 | 40 | 30 | 55 | 70 | 75 | 20 | 27 | 20 |
| pH | | | | | | | | | 1.9* | 2.0* |

[1]Akypo TCF is lauryl polyglycolether ($EO_3$) carboxylate ex Chem-Y.
[2]Akypo RLM100 is lauryl polyglycolether ($EO_4$) carboxylate ex Chem-Y.
[3]Akypo RLM160 is lauryl polyglycolether ($EO_{16}$) carboxylate ex Chem-Y.
[4]Emal 10 is ($C_{12}$–$C_{14}$) primary alkyl sulphate ex Kao Atlas.
*pH adjusted with KOH.

EXAMPLE VI

| Ingredients | 1 | 2 | 3 | 4 |
|---|---|---|---|---|
| $H_2SO_5$ | 4.0 | 3.0 | 6.0 | 3.0 |
| $H_2SO_4$ | 1.6 | 1.2 | 2.3 | 1.2 |
| $H_2O_2$ | 0.5 | 0.3 | 0.7 | 0.3 |
| DOBS 80 | 4.0 | 3.0 | 6.0 | 3.0 |

EXAMPLE VI-continued

| Ingredients | 1 | 2 | 3 | 4 |
|---|---|---|---|---|
| Sec.ethoxylated alcohol ($C_{14}$–$C_{16}$, $EO_9$) | 1.0 | — | — | — |
| Dobanol 91-5[1] | — | 1.0 | — | — |
| Surfactant T5[2] | — | — | 1.0 | — |
| Triton X-100[3] | — | — | — | 1.0 |
| Initial viscosity (mPa.s, at 21 $s^{-1}$) | | 77 | 50 | 57 |

[1]Dobanol 91-5 is prim. ethoxylated alcohol ($C_9$–$C_{11}$, $EO_5$) ex Shell.
[2]Surfactant T5 is sec. ethoxylated alcohol ($C_{11}$–$C_{15}$, $EO_5$) ex B.P. Chemicals.
[3]Triton X-100 is ethoxylated ($EO_{10}$) octylphenol ex Rohm and Haas.

EXAMPLE VII

| Ingredients | 1 | 2 | 3 | 4 | 5 | 6 |
|---|---|---|---|---|---|---|
| $H_2SO_5$ | 4.0 | 3.3 | 4.0 | 4.0 | 4.0 | 4.0 |
| $H_2SO_4$ | 1.6 | 1.3 | 3.1 | 1.6 | 1.6 | 1.6 |
| $H_2O_2$ | 0.5 | 0.4 | 0.5 | 0.5 | 0.5 | 3.5 |
| $H_3PO_4$ | — | — | — | 8.0 | — | — |
| $KH_2PO_4$ | — | — | — | — | 7.0 | — |
| DOBS 80 | — | — | 2.0 | 4.0 | 4.0 | 4.0 |
| DOBS 83 | 4.0 | 4.9 | 4.0 | — | — | — |
| DOBS 102 | — | — | — | 1.5 | — | 2.0 |
| Perfume GC213[1] | 0.2 | — | — | — | — | — |
| Perfume GC360[2] | — | 0.2 | — | — | — | — |
| Initial viscosity (mPa.s, at 21 $s^{-1}$) | 38 | 45 | 65 | 50 | 25 | 39 |

[1]GC213 is a "fresh citrus pine" perfume ex PPF International.
[2]GC360 is an aldehydic "green floral" perfume ex PPF International.

EXAMPLE VIII

| Ingredients | 1 | 2 | 3 | 4 |
|---|---|---|---|---|
| $H_2SO_5$ | 2.0 | 3.0 | 4.0 | 3.0 |
| $H_2SO_4$ | 0.8 | 1.2 | 1.6 | 1.2 |
| $H_2O_2$ | 0.2 | 0.3 | 0.5 | 0.3 |
| DOBS 80 | — | — | 2.0 | 2.0 |
| DOBS 102 (Na-salt) | 3.0 | 3.6 | 2.0 | — |
| Alkane 56[1] | — | — | — | 3.0 |
| Initial viscosity (mPa.s, at 21 $s^{-1}$) | 24 | 66 | 24 | 65 |

[1]Alkane 56 is a branched alkyl benzene sulphonate ex Carioca.

EXAMPLE IX

| Ingredients | 1 |
|---|---|
| $H_2SO_5$ | 3.0 |
| $H_2SO_4$ | 1.2 |
| $H_2O_2$ | 0.3 |
| DOBS 80 | 5.3 |
| Empigen OB[1] | 0.7 |
| Initial viscosity (mPa.s, at 21 $s^{-1}$) | 40 |

[1]Empigen OB is ($C_{12}$–$C_{14}$) alkyldimethyl amineoxide ex Albright & Wilson.

EXAMPLE X

| Ingredients | 1 | 2 | 3 |
|---|---|---|---|
| $H_2SO_5$ | 3.2 | 2.8 | 3.0 |
| $H_2SO_4$ | 1.2 | 1.1 | 1.2 |
| $H_2O_2$ | 0.4 | 0.3 | 0.3 |
| DOBS 80 | — | 2.8 | — |
| DOBS 102 (Na-salt) | 1.9 | — | — |
| ESON 3[1] | 1.5 | 2.4 | 3.6 |
| ESON 5[2] | 1.9 | 1.6 | 2.6 |
| Initial viscosity (mPa.s, at 21 $s^{-1}$) | 40 | 105 | 128 |

[1]ESON 3 is an in-house manufactured alkyl polyglycolether propylsulphonate ($C_{12}$–$C_{15}$, $EO_3$).
[2]ESON 5 is an in-house manufactured alkyl polyglycolether propylsulphonate ($C_{12}$–$C_{15}$, $EO_5$).

We claim:

1. Aqueous stable thickened low-pH bleacing composition with a viscosity ranging from 10 to 250 mPa.s, consisting essentially of:

(a) from 1 to 7.5% by weight of a thickening synthetic anionic surfactant selected from the group consisting of alkyl-, alkenyl- and alkylaryl sulphonic acids, -polyglycolether sulphonic acids, and the salts thereof;

(b) from 0.5 to 10% by weight, calculated on the basis of the acid form, of a cold-water-soluble inorganic peroxy compound;

(c) from 0.5 to 20% by weight of an acidic compound which is selected from the group of strong mineral acids and the partial salts thereof, capable of providing the composition with a pH value of below 4; and (d) an effective amount of co-surfactant not to exceed 5%.

2. A composition according to claim 1, wherein the peroxy compound is peroxymonosulphuric acid or an alkali metal or ammonium salt thereof.

3. A composition according to claim 1, which further comprises 1 to 5% by weight of hydrogen peroxide.

4. A composition according to claim 1, wherein the thickening surfactant is selected from the group of alkylaryl sulphonates having from 9 to 20 carbon atoms in the alkylaryl radical.

5. A composition according to claim 1, wherein the thickening surfactant is selected from the group of alkylaryl polyglycolether sulphonates having from 8 to 18 carbon atoms in the alkylaryl radical and from 1 to 4 carbon atoms in the alkyl linkage between the polyglycol portion and the sulphonate group.

6. A composition according to claim 1, wherein the co-surfactant is an alkoxylated primary or secondary fatty alcohol, the weight ratio between the thickening surfactant and the co-surfactant being at least 1:1.

7. A composition according to claim 6 wherein the alkoxylated primary or secondary fatty alcohol is a $C_{11}$–$C_{15}$ ethoxylated alcohol having from about 3 to about 16 average moles ethylene oxide.

* * * * *